United States Patent [19]

Yurchenco et al.

[11] Patent Number: 4,752,101

[45] Date of Patent: Jun. 21, 1988

[54] TILT CONTROL ARRANGEMENT FOR OFFICE FURNITURE CHAIR

[75] Inventors: James R. Yurchenco; Rickson Sun, both of Palo Alto, Calif.

[73] Assignee: Allsteel Inc., Aurora, Ill.

[21] Appl. No.: 60,920

[22] Filed: Jun. 12, 1987

[51] Int. Cl.[4] ..... A47C 1/024; A47C 3/026

[52] U.S. Cl. ..... 297/304; 248/578; 267/154; 297/301; 297/303; 297/326

[58] Field of Search ..... 297/300–305, 297/325–328; 248/575, 577, 578, 635; 267/154, 279

[56] References Cited

U.S. PATENT DOCUMENTS

| | | | |
|---|---|---|---|
| 2,082,499 | 6/1937 | Keyworth | 248/577 |
| 2,228,719 | 1/1941 | Bolens | 248/575 |
| 2,283,062 | 5/1942 | Herold | 297/303 X |
| 2,374,350 | 4/1945 | Herold | 297/301 |
| 2,463,257 | 3/1949 | Fox | 297/301 |
| 3,453,024 | 7/1969 | Williams | 297/304 |
| 3,672,721 | 6/1972 | Williams | 297/302 |
| 4,013,258 | 3/1977 | Doerner | 297/303 X |
| 4,014,086 | 3/1977 | Doerner | 297/303 |
| 4,018,415 | 4/1977 | Wolters | 248/381 |
| 4,479,679 | 10/1984 | Fries et al. | 297/300 |

FOREIGN PATENT DOCUMENTS

| | | | |
|---|---|---|---|
| 79530 | 5/1983 | European Pat. Off. | 297/325 |

*Primary Examiner*—Kenneth J. Dorner
*Assistant Examiner*—Peter R. Brown
*Attorney, Agent, or Firm*—Mann, McWilliams, Zummer & Sweeney

[57] ABSTRACT

A tilt control arrangement for office furniture chairs of the type having a chair seat structure mounted on a supporting base for rearward and forward tilting movement of the chair seat about an essentially horizontal axis extending essentially crosswise of the seat. The tilt control arrangement comprises a bifurcated seat structure mounting member defining a pair of parallel arms for pivotally mounting the seat structure for its tilting movement. Depending from the underside of the chair seat structure 15 a lug that projects below the level of the chair seat tilt axis. A front to rear extending rod member extends freely through the chair seat lug to have its rear end threadedly engaged with a nut anchored to the chair base, and the rod member having its forward end headed. A resiliently elastomeric cylindrical body is made fast to the rod member only at the rod member head, with the elastomeric body being placed in compression between the rod member head and the seat lug. Compression of the body can be adjusted by rotating the elastomeric body to adjust the tilting resistance of the seat.

11 Claims, 3 Drawing Sheets

10
12
14
16
18
20
21
22
24
30
32
34
36
38
40
40A
46
48
50
51
58
59
64
66
68
70
72
74
76
78
79
86
88
90
92
94
96
102
104
106
108
110
112
116
118
130
132
133
134
137

TILT CONTROL ARRANGEMENT FOR OFFICE FURNITURE CHAIR

This invention relates to a tilt control arrangement for office furniture chairs, and more particularly, to an office furniture chair seat tilt control that is especially suited for chairs of the swivel type.

Office furniture chairs, except those of the side chair type, are usually swivel chairs that are caster supported and are also usually arranged to provide for the chair seat back and forward tilting, seat height adjustment, or both, for user comfort. Where chair seat tilting movement is available, from a chair seat full upright position, the seat tilting action conventionally is resiliently opposed by a tilt control mechanism that normally can be adjusted by the chair user.

While chairs of this type are more likely to be more comfortable if they can be adjusted, experience has shown that many office chair users do not use the chair adjusting mechanisms that the chair is provided with, as the individuals involved prefer to cope with minor discomfort rather than cope with the complicated, or hard to reach or operate, adjustment mechanism. Further, conventional tilt control arrangements even if used, involve backward tilting of the chair that effects what the Applicant has found to be an objectionable amount of upward movement adjacent the front of the chair.

A principal object of the present invention is to provide a chair seat tilt control arrangement that can easily be adjusted by the chair user while remaining seated in the chair.

Another principal object of the invention is to arrange the chair seat tilt control and adjustment therefor so that the entire mechanism is under but at a level adjacent the chair seat, and disposes a tilt control adjustment "handle" that is at the front of the chair for ready gripping for adjustment purposes by the chair user while the chair user remains seated in the chair.

Yet a further principal object of the invention is to arrange the chair seat tilt control so that the tilting action provided is rearward from a full upright seat position, with the tilt action of the seat being automatically opposed by a resilient elastomeric body acting in compression, and the upward movement of the chair seat adjacent the front of the chair being a fraction of the downward movement of the chair seat at the rear of the chair.

Still a further object of the invention is to provide a chair seat tilt control arrangement that is essentially horizontally disposed in a front to rear position below the seat tilt axis, but sufficiently close to the level of the seat front to permit adjustment of the tilt control arrangement involved without the chair user having to leave the chair.

Still another principal object of the invention is to arrange the chair seat tilt control so that the seat tilting action is opposed by a cylindrical body of resiliently elastomeric material acting in compression, which body also serves as the "handle" for adjusting the tilt control.

A further major object of the invention is to arrange the chair seat tilt control so that in the full upright position of the chair seat, the chair seat can be releasably locked against tilting movement.

A further object of the invention is to provide a chair seat tilt control arrangement for office furniture chairs that is inexpensive of manufacture, reliable and long lived in use, and that can be adjusted by the chair user merely rotating the tilt movement resisting body involved, by grasping same where it is conveniently disposed for this purpose below the front of the chair seat, and without the chair user having to leave the chair seat to make the adjustment desired.

In accordance with the invention, an office furniture chair seat tilt control arrangement is provided that is especially suited for office chairs of the swivel type, comprising a bifurcated chair seat mounting member that is applied in upright relation to the conventional chair base supported component that provides the seat swiveling action, which may be in the form of a suitable pedestal structure arranged conventionally to provide for height adjustment of the chair seat mechanically or pneumatically. The invention seat mounting member comprises a hub portion that is to be coaxial with and on the swivel axis of the chair and defines a pair of laterally extending parallel arms that pivotally mount the chair seat for its tilting movement, with the pivotal connection between the chair seat and the arms of the seat mounting member providing a rearward tilting action of approximately fifteen degrees from a full upright position, but with the tilt axis involved being sufficiently to the front of the seat so that the front edge of the seat rise from a full upright position to full tilt rearwardly is no more than about an inch.

The tilt control arrangement involved include a lug depending from the chair seat structure underside that projects between the seat mounting member arms and below the level of the chair seat tilt axis, and an elongate front to rear extending rod member that extends freely through the seat underside lug to have its rear end threadedly engaged with a nut anchored to the chair mounting member and having the forward end of the rod member headed. Coaxially mounted on the rod member at its forward end is a resilient elastomeric cylindrical body that essentially masks the rod member and that is fixed to the rod member head only, with the rod member and elastomeric body being free of each other rearwardly of the rod head for relative movement therebetween. The elastomeric body is placed in compression between the rod member head and the seat lug structure, with the seat lug structure being provided with a trunnion for the purpose of equally applying the resistance of the elastomeric body to the seat lug structure on either side of the lug structure aperture through which the rod member extends, with the seat lug structure being seated against a stop wall that is part of the chair seat mounting member and is located between said arms thereof.

The anchored nut and rod member are located so that the longitudinal axis of the rod member is below the level of the chair seat tilt axis, and also is essentially horizontally disposed, with the arrangement being such that compression of the elastomeric body disposes the chair seat in its full upright position, and controls the tilt of the chair rearwardly of its full upright position, which control can be adjusted by rotating the elastomeric body, and thus threading the rod member with respect to its nut, to change the compression that the elastomeric body is placed under, as needed due to the weight of the individual using the chair and the amount of backward tilt that is desired from the chair seat full upright position.

The invention also provides a locking arrangement for locking the chair seat against tilt rearwardly of the full upright position, which can also be operated by the chair user without having to leave the chair. The general arrangement involved is in the nature of a slide lever located on one side of the chair beneath the chair and arranged to move between locking and unlocking relations when the chair seat is in its full upright position.

Other objects, uses, and advantages will be obvious or become apparent from a consideration of the following detailed description and the application drawings, in which like reference numerals indicate like parts throughout the several views.

Figures 1, 2:
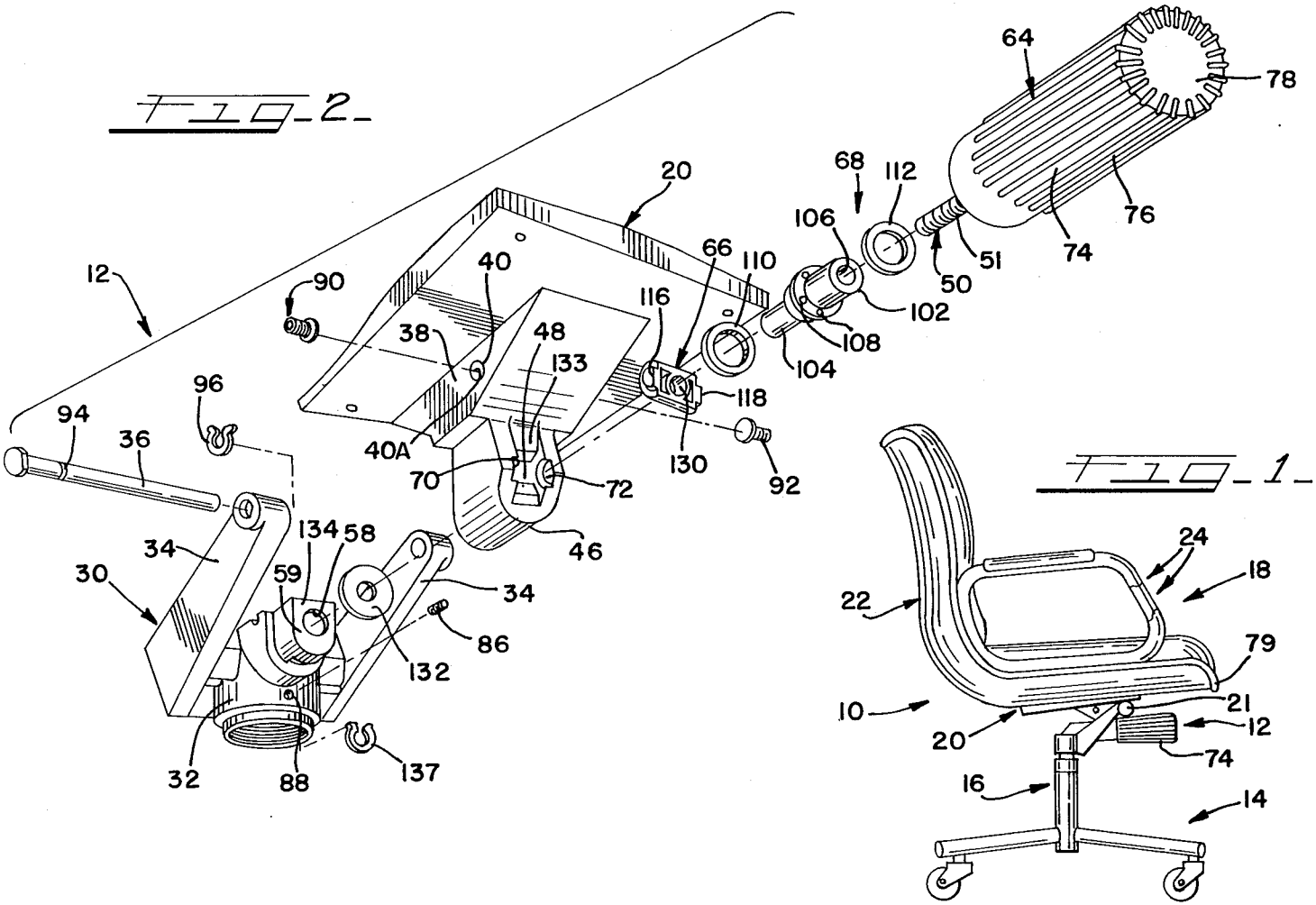
FIG. 1 is a side elevational view of a conventional office furniture swivel chair equipped with the seat tilt control arrangement of the present invention.
FIG. 2 is a diagrammatic, exploded perspective view illustrating a number of the basic components of the chair seat tilt control arrangement of the present invention.
Figures 3, 4, 4A:
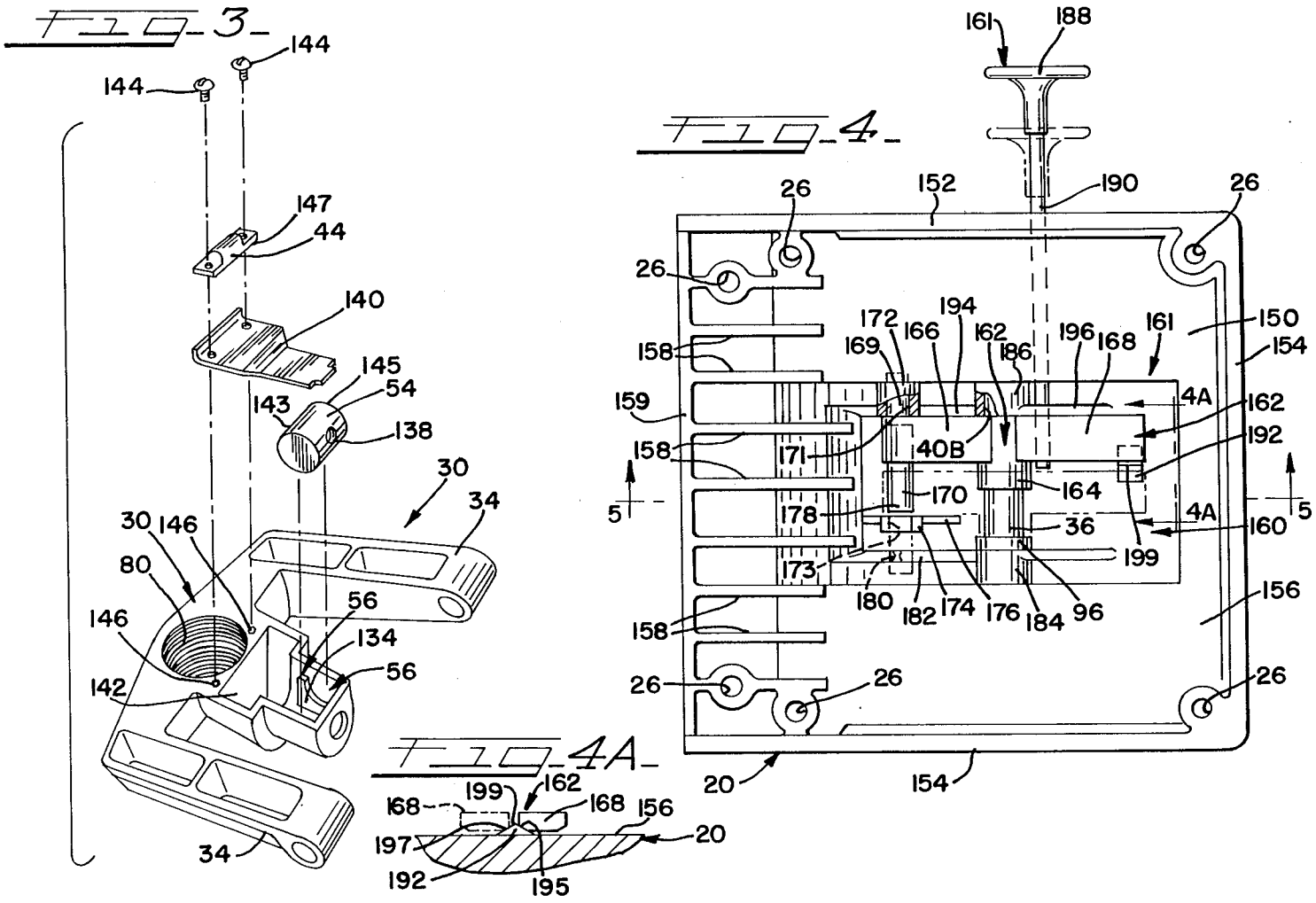
FIG. 3 is a diagrammatic, exploded perspective view of the seat mounting member of FIG. 2 and associated components that are applied to same to complete the chair seat tilt control arrangement involved.
Figure 5:
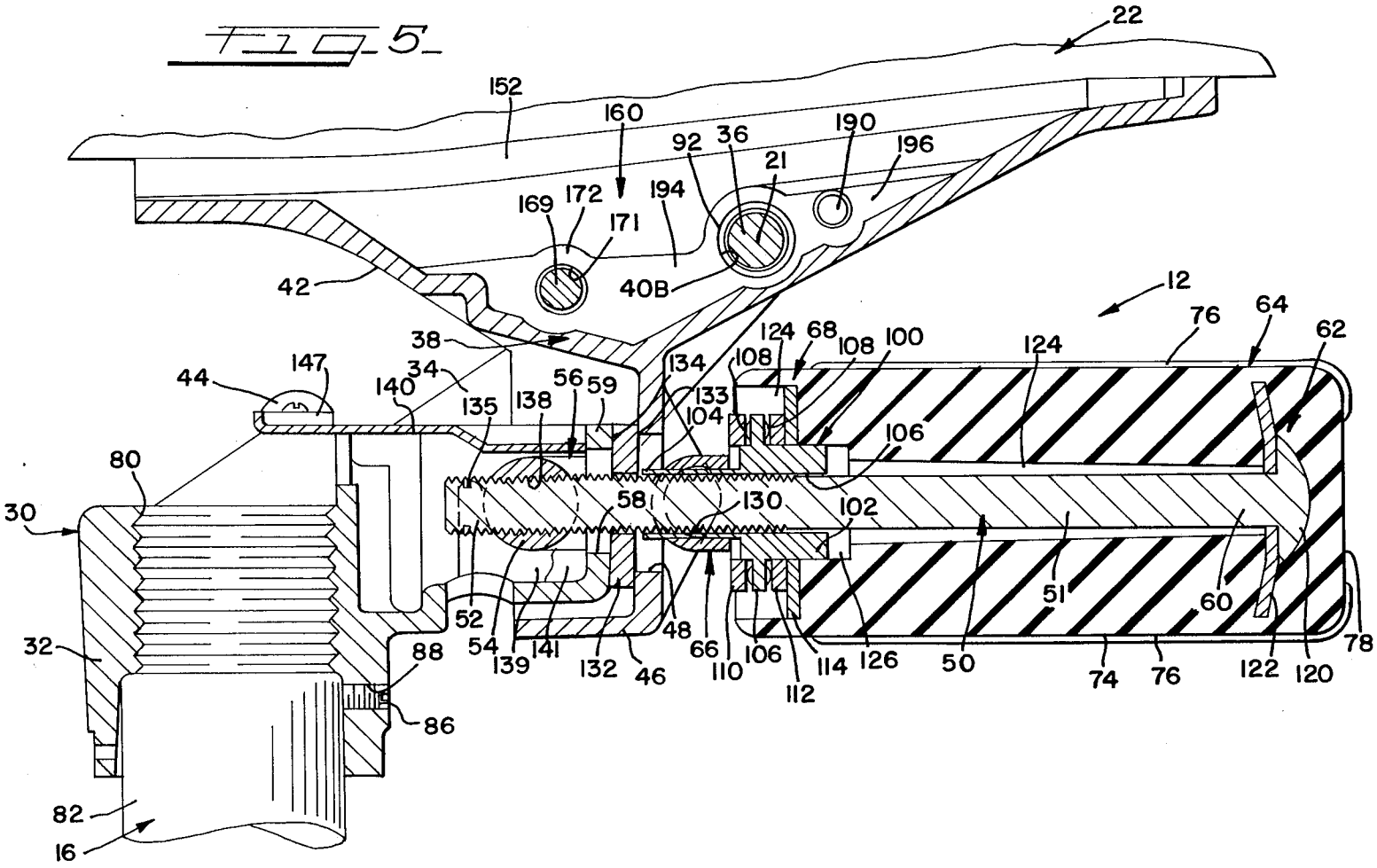

FIG. 4 is a top plan view of the chair seat underplate arrangement that is employed to provide tilt control for the chair seat of FIG. 1, but shown partially broken away, illustrating also a two position showing of a chair seat tilt lock, with the full line position of the chair seat tilt lock components involved showing the chair seat locked in full upright position, and the phantom position of the chair seat tilt lock components showing the chair seat unlocked for controlled tilt action rearward from the full upright position and return to the full upright position under the bias of the invention tilt control;

FIG. 4A is a diagrammatic fragmental sectional view illustrating a feature of the tilt lock arrangement shown in FIG. 4, and taken substantially along line 4A—4A of FIG. 4; and FIG. 5 is a diagrammatic sectional view taken approximately on line 5—5 of FIG. 4, illustrating the basic components of the invention tilt control arrangement in assembled relation, with the chair seat underplate being disposed at the full upright position of the chair.

However, it is to be distinctly understood that the specific drawing illustrations provided are supplied primarily to comply with the requirements of the Patent Laws, and that the invention is susceptible of other embodiments or modifications that will be readily apparent to those skilled in the art, and which are intended to be covered by the appended claims.

GENERAL DESCRIPTION

Reference numeral 10 of FIG. 1 generally indicates an office furniture swivel chair to which the tilt control arrangement 12 of the present invention has been applied. The chair 10 in addition to the tilt control arrangement 12 thus comprises the usual caster wheel equipped armed base 14 to which suitable pedestal 16 is connected and mounted for swiveling action about an essentially vertical axis.

The tilt control arrangement 12 is mounted on top of pedestal 16 and is arranged in association with a seat underplate 20 to pivotally mount the chair seat structure 18 for tilting movement about a horizontally disposed axis 21 from the full upright position of the chair seat structure 18 shown in FIG. 1, rearwardly of the chair 10.

The chair seat structure 18 may be of any conventional type, that shown being of the shell chair type disclosed in Massaccesi U.S. Pat. No. 3,788,701, granted Jan. 29, 1974. The chair seat structure 18 thus comprises shell 22 that has the same various components including framework, padding and the like, that make up a conventional office furniture swivel chair seat structure 18, and to which suitable arms 24 may be optionally secured at either side of same, as desired. In the particular seat structure 18 that is illustrated, seat underplate 20 is affixed to the seat portion defined by shell 22 by suitable bolts (not shown) applied to apertures 26 that are formed in seat underplate 20, as illustrated in FIG. 4. Seat plate 20 is suitably centered with and under chair seat structure 18 in accordance with the usual seat structure mounting technology.

The tilt control arrangement 12 generally comprises bifurcated seat mounting member 30 defining a central hub portion 32 that is suitably mounted on the chair pedestal 16 and a pair of upwardly angled coplanar arms 34 that receive the axle or pivot pin 36 that journals the chair seat structure 18 for pivoting movement about the tilt axis 21 that is thus defined by the longitudinal axis of the pin 36.

In the form shown, the seat underplate 20, to which the seat structure 18 is anchored, is formed to define depending lug 38 that is apertured as at 40 to receive the pin or axle 36 therethrough. As indicated in FIG. 5, the underplate lug 30 is thus received between the arms 34 of mounting member 30 for tilting movement about the longitudinal axis 21 of the pin or axle 36 between the full upright position of the chair seat that is shown in FIGS. 1 and 5 and a full rearwardly tilted position in which the seat plate lug back wall 42 engages the stop member 44 that is secured to the seat mounting member 30 in the manner that will be described hereinafter.

It will be observed that the seat underplate lug 38 is extended downwardly to form an extension 46 that is apertured as at 48 (see FIG. 5) to receive and freely pass an elongate rod member 50 which extends from front to rear of the seat structure 18 and is externally threaded at its rear end 52 for application to a barrel type nut 54 that is received in a nut chamber 56 (see FIG. 5) defined by the seat mounting member 30. The rod member end 52 enters the chamber 56 through centrally located aperture 58 formed in the thrust resisting wall 59 (of mounting member 30).

The rod member 50 at its forward end 60 is formed to define a head structure 62 that, in the form shown, is embedded in a generally cylindrical resilient elastomeric body 64, with the arrangement being such that the body 64 is adhered only to the head structure 62 defined by rod member 50.

The body 64 between the head structure 62 and trunnion 66 (and through the thrust bearing assembly 68 associated with same) is placed in compression, with the trunnion 66 rockably seated in opposed semicircular recesses 70 and 72 that are defined by the lug extension 46, for purposes of transmitting the compression forces involved to the seat underplate 20 and thus to the seat structure 18, which compressive forces normally hold the seat structure 18 in its full upright position, and bias the seat structure 18 against back tilting about the axis 37 counterclockwise of FIGS. 1 and 5. Such compression forces the seat lug extension 46 against the thrust resisting wall 59 of mounting member 30.

As will be clear from the showing of FIGS. 1 and 5, the individual using the chair 10 can adjust the tilt control device arrangement 12 while he remains seated in the chair, by reaching under the chair and grasping the exterior surfacing 74 of body 64, to rotate the body 64 and the rod member 50 associated therewith so as to thread the rod member 50 to the left or to the right of FIG. 5 to increase or decrease the compressive forces applied to the chair seat structure by the arrangement 12. As indicated in FIGS. 1, 2 and 5, the external surfacing 74 of body 64 is knurlled for this purpose, with the knurlling being in the form of upstanding side ribs 76 that extend over to the body forwardly or frontwise facing end 78.

A feature of the present invention is that the location of the seat underplate pivot aperture 40, and thus tilt pivot axis 21, is sufficiently toward the front of the chair seat structure 18 that the front edge 79 of the chair seat structure 18 will rise no more than than about one inch when the underplate lug back wall 42 engages stop 44, which for the illustrated tilt control arrangement, allows for a rearward tilting action from the position of FIG. 5 of about fifteen degrees about axis 21.

SPECIFIC DESCRIPTION

Referring again to FIGS. 1 and 2, the seat mounting member 30 preferably is of one piece construction formed from a suitable aluminum alloy to provide the hub portion 32, the bifurcation in the form of spaced parallel arms 34, the barrel nut receiving chamber 56, the thrust resisting wall 59, and the threaded bore 80 that threadedly receives the upper end 82 of the chair pedestal 16, or any equivalent structure for swivelably mounting the mounting member 30 on the chair base 14. Suitable set screw 86 applied to threaded bore 88 of the mounting member hub portion keys the mounting member 30 at the desired position relative to the pedestal 16.

The pivot pin or axle 36 in the illustrated embodiment is applied through suitable tubular bearings 90 and 92, that are applied to the opposite end portions 40A and 40B of the aperture 40 of the seat underplate lug 30 to journal the pin 36 in operating position, with the bearings 90 and 92 being formed from a suitable self lubricating plastic material. Pin or axle 36 is grooved as at 94 to receive suitable locking clip 96 (see FIGS. 2 and 4), after the pin or axle 36 has been applied to the bearings 90 and 92 and aperture 40, to hold these components in assembled relation, in the illustrated embodiment.

As illustrated in FIGS. 2 and 5, the thrust bearing assembly 68 comprises a tubular spacer member 100 having a thickened head portion 102 and a relatively thin tail portion 104 that are coaxially related and integrally united to define a common bore 106 through spacer member 100 that is proportioned to freely receive the shank 51 of the rod member 50. In the form shown, the tubular spacer member 100 defines a radial external flange 106 formed with spaced spherically contoured protuberances 108 on either side of same (see FIG. 5), with the radial flange 106 separating a pair of thrust washers 110 and 112 that are received on the head portion 102 of the tubular spacer 100, as is also an annular pressure plate 114 that is to seat against thrust washer 112.

In the tilt control arrangement 12 that has been illustrated, the body 64 is to be compressed between the head structure 62 of rod member 50 and the annular pressure plate 114; this seats pressure plate 114 against the thrust washer 112 that in turn seats against the annular flange 106 with the annular flange 106 in turn seating against thrust washer 110 that in turn seats against the oppositely extending ends 116 and 118 of the trunnion 66, which as already indicated, is rockably engaged within the respective recesses 70 and 72 of seat lug 58, for in effect compressing the body 64 between the head structure 62 of the rod member 50 and the seat underplate lug 38.

In the form shown, the head structure 62 of rod member 50 comprises a rod head 120 (see FIG. 5) that has applied against same annular brace plate 122, with the rod member head member 120 and the brace plate 122 being embedded within the body 64 when the body 64 is formed, using suitable molding procedures for this purpose, which also result in the defining of the body central bore 124, the body cylindrical chamber 126 in which the tubular spacer head portion 102 is slidably received, and the body end recess 126 in which the thrust plate 114 is slidably received. Body 64 is preferably formed from a suitable artificial or natural rubber material, such as neoprene rubber, with the rod member head structure 62 being embedded adjacent the forwardly extending end 78 of same to fix the body 64 to rod member 50 only at its head structure 62.

As further indicated in FIG. 5, the tubular spacer tail portion 104 extends through the bore 130 defined by trunnion 66 and overlies a portion of the external threading of the rod member 50, as indicated in FIG. 5. The tail portion 104 in the form shown is also centered coaxially of aperture 58 of member 30, with the thrust acting on seat plate lug 38 of the illustrated arrangement seating its lug wall 133 against stop washer 132 that abuts mounting member thrust wall 59 at its surfacing 134 in the full upright (tilt free) position of seat structure 18.

In the form shown, the end 52 of rod member 50 is suitably recessed as at 135 to receive retainer clip 137 that is applied thereto to insure that rod member 50 remains in threaded relation with nut 54.

As indicated in FIGS. 3 and 5, the nut receiving chamber 56 of the mounting member 30 is formed in part by thrust resisting wall structure 59 (that is integral with mounting member 30); chamber 56 is formed internally to define a pair of opposed ribs 139 and 141 on which opposite ends 143 and 145 of the nut 54 are respectively seated. Nut 54 is of cylindrical configuration and defines internally threaded cross bore 138 that threadedly receives the threaded shank 51 of rod member 50. When the nut 54 is received against the chamber 56 with the rod member 50 and retainer clip 137 applied thereto in the manner that has been indicated, retainer plate 140 covers the chamber 56 and its extension 142, with the stop member 44 being in the nature of a cap 147 applied on top of the cover plate 140 in the manner suggested in FIGS. 3 and 4 and secured in place to the mounting member 30 by appropriate threaded shoulder screws 144 applied to the internally threaded apertures 146 formed in the member 30.

Referring now more specifically to FIGS. 2 and 4, the seat plate 20 is preferably formed from a suitable aluminum alloy to define a base plate portion 150 having a pair of opposed, upstanding side walls 152 and 154 joined across the front of the seat plate by upstanding end wall 154. Plate 20 is suitably formed by employing appropriate molding techniques to define the bolt receiving openings 26 by which the seat plate 20 is suitably bolted to the chair seat structure 18 in any conventional manner.

In the form shown, the upper side 156 of the seat plate 20 is suitably flanged as at 158 along the rear edging 159 of same, with the flanging 158 being for structural strength and rising less than the plate side walls 152 and 154. The specific seat plate 20 illustrated involves lug 38 being hollow from the upper side of same, to define tilt lock chamber 160 for tilt lock device 161, and the spaced chair tilt pivot axle receiving aperture portions 40A and 40B.

As indicated in FIGS. 4 and 5, the pivot pin or axle 36 extends across chamber 160, aperture 40 comprising the indicated pair of aperture portions 40A and 40B that are axially aligned to receive pin or axle 36, and are disposed on opposite sides of chamber 160 for this purpose. Shiftably mounted in the chamber 160 is tilt lock member 162 (of lock device 161) that comprises tubular member 164 slidably mounted on the pin or axle 36 and defining integral wing arms 166 and 168 that respectively extend rearwardly and forwardly of the seat plate 20. The wing 166 is integral with oppositely directed pin sections 169 and 170, with the pin section 169 being adapted to be received in the through bore 171 defined by plate 20; within chamber 160, bore 171 is concentric with tubular stud 172 that is also defined by plate 20. The pin section 170 extends from the other side of the wing arm 166 and is adapted to be received in the bore 173 of tubular section 174 that is integral with seat plate base flange 176; in addition, the end portion 178 of the pin section 170 in the unlatched relation of the tilt lock that is shown in dashed lines in FIG. 4 is adapted to be received in and through a suitable aperture 180 formed in flange 182 of plate 20. Flange 182 is integral with tubular stud 184 that defines aperture portion 40A which receives the pin or axle 36. In the form illustrated, pin section 170 and the bores it is to be received in are coaxially aligned and are disposed within chamber 160. Tubular stud 184 is also disposed in chamber 160, and aperture portions 40A and 40B both extend through the plate 20 in alignment with pivot axis 21.

On the other side of the chamber 160, in addition to the tubular stud 172, the plate 20 defines, within chamber 160, a tubular stud 186 with which through aperture portion 40B is concentric. As indicated, aperture portion 40B also receives the pin or axle 36.

Handle 188 that operates the tilt lock device 161 is suitably fixed to rectilinear operating rod 190 that in turn passes through suitable aperturing in the plate 20 for suitable fixed engagement with the locking member 162 (which may be in the form of suitable affixing to member 162 by an adhesive, or the like). The handle 188 and its operation are thus at a level that is below but adjacent the chair seat structure 18, with handle 188 being disposed at the left hand side of the chair 10 in the illustrated embodiment (though handle 188 and its operating 190 obviously could be applied to plate 20 and tilt lock member 162 so as to be operable from the right hand side of chair 10 if so desired).

When the handle 188 and its operating rod 190 are in the full line position of FIG. 4, the tilt lock member 162 is in the full line position of the same FIGURE to dispose its pin section 169 in the seat plate bore 171, which locks the plate 20 in the full upright position of the chair seat, and against tilting movement therefrom. The forward extending wing 168, is flexibly associated with an upstanding triangular protuberance 192 defined by the plate 20 within chamber 160, with the wings 166 and 168 seating against the upright parallel flanges 194 and 196 of plate 20, at one side of chamber 160, in the tilt locking relation of the lock member 162 (as shown in FIG. 4).

Shifting of the tilt lock operating handle 188 and operating rod 190 to the dashed line position of FIG. 4 disposes the tilt lock member 162 in the unlocking relation of the device, wherein the pin section 169 is withdrawn from the seat plate bore 171, and thus from tubular stud 172, and the pin section 170 is disposed within the tubular section 174 and the aperture 180 of the flange 182, as indicated by the dashed lines of FIG. 4. In moving to this position, the wing 168 rides over the top of the triangular protuberance 192 and sits in the dashed line position suggested by FIG. 4A, and wings 166 and 168 are spaced from the seat plate flanges 194 and 196. The tilt lock member 162 is thus formed from a suitable resiliently flexible plastic material, such as nylon or the like, for accommodating flexing of the wing 168 of lock member 162 as member 162 is shifted between the two positions indicated in FIG. 4A so as to engage the respective slanted side surfacings 195 and 197 of seat plate protuberance 192 (and thus ride over apex 199 of protuberance 192).

The tilt locking device 161 is thus operated by moving the operating handle 188 and operating rod 190, and thus tilt lock member 162, between the two positions shown in FIG. 4, and only when the chair seat structure 18 is in its full upright position; in such position, the seat plate defined bore 171 will be aligned with lock member section 169, but not when the chair seat structure 18 is tilted to the rear from the position of FIG. 5 (which shows the full upright position of seat plate 20.

It is pointed out that the tilt lock member 162 is omitted from the showing of FIG. 5, with FIG. 5 being expanded over FIG. 4 to include in longitudinal section the component parts of the tilt control arrangement 12 in addition to the seat plate 20.

It will thus be seen that should the user of the chair 10 wish to adjust the tilt control arrangement 12, it is merely necessary for the user to reach under the front of the chair seat, and hand grasp and turn the body 64, which serves as a "handle" for adjusting the tilt control arrangement 12 to provide the desired amount of resistance to rearward tilting from the full upright position of the chair seat structure 18.

Likewise, the tilt lock arrangement 161 is operated below the chair seat from the left hand side of the chair (in the illustrated embodiment), again without the chair user having to leave the seat to operate same.

It will thus be seen that the tilt control arrangement 12 and the tilt lock arrangement 161 are both easy for the chair user to reach from a seated position within the chair 10, are easy to understand, and are simple to operate. Further, the seat underplate tilt pivot axis 21, and thus aperture portions 40A and 40B of seat plate 20, are located sufficiently toward the front of the chair, so that the front edge 79 of the chair seat structure 18 will rise no more than about one inch when the chair seat plate lug back wall engages stop 44 at the full back tilt position (a tilting action backward from the position of FIG. 5 of about fifteen degrees being preferred for the illustrated embodiment); this type of chair tilt action achieves improved comfort for the chair user, as compared to conventional chair back tilt arrangements that effect rise of the chair front, when maximum back tilt of the chair seat is effected, well over the Applicant's approximate one inch rise limitation; such rise at the front of the chair for conventional chair tilt arrangements may be as much as two to three inches, and lift the chair user's shoes well above the floor.

The tilt lock arrangement 161 is considered an option for application to chairs having the tilt control arrangement 12 applied thereto so that when the chair tilt control is properly adjusted, the user of the chair may lock the chair in its fully upright position when the user is to leave the chair, with the result that the chair seat involved will be in the same position when the user returns to the chair.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a chair having a seat structure mounted on a base for rearward and forward tilting movement about an essentially horizontal axis, a resilient tilt control device therefor comprising:

a rod member having one end thereof threaded for threaded application to the chair base below the chair tilt axis, an elongate resilient body formed from elastomeric material coaxially mounted on said rod member, said rod member at said other end defining a head, means fixing said head to the body for simultaneously rotating said body and rod member, and a thrust seat defined by the chair seat structure below the horizontal axis between which and said rod head said body is adjustably compressed for resiliently controlling the chair seat tilting movement.

2. In a chair having a seat structure mounted on an upright support post for rearward and forward tilting movement about an essentially horizontal axis, a resilient tilt control assembly therefor comprising:

a seat mount member mounted adjacent the upper end of said post, said seat mount member defining a thrust resistant wall structure and being bifurcated to define a pair of parallel arms disposed to either side of said wall structure, said arms having projecting ends, means for journalling the seat structure in said arms for providing the tilting movement about the horizontal axis, a lug structure fixed with respect to the seat structure and projecting below the horizontal axis and between said seat mount arms, a nut carried by said seat mount member below the horizontal axis and anchored to said seat mount member in spaced relation to said lug structure, an elongate rod member freely received through said lug structure and said mounting member wall structure, and having one end of same threadedly connected to said nut and being headed adjacent the other end of same, and an elongate resiliently compressible elastomeric body coaxially mounted on said rod member between said rod head and said lug structure, means fixing said elastomeric body to said rod member for simultaneously rotating said body and said rod member about the longitudinal axis of said rod member relative to said nut to adjustably compress said body between said rod member head and said lug structure for controlling the chair seat structure tilt movement about said axis, and for biasing said lug structure against said mounting member wall structure, whereby manual rotation of said body about the longitudinal axis of said rod member provides adjustment of the tilt control provided by said assembly.

3. The tilt control assembly set forth in claim 2 wherein:

said body projects forwardly of the seat structure.

4. The tilt control assembly set forth in claim 3 wherein:

said rod member head is embedded in said body adjacent the projecting end thereof.

5. The tilt control assembly set forth in claim 2 wherein:

said body defines a round external side wall extending longitudinally thereof that is coaxially related to said longitudinal axis of said rod member.

6. The tilt control assembly set forth in claim 5 wherein:

said side wall of said body is knurled.

7. The tilt control assembly set forth in claim 2 including:

a trunnion interposed between said lug structure and said body for transmitting to said lug structure the compressive forces of said body opposing the tilting movement.

8. The tilt control assembly set forth in claim 2 wherein:

said rod member is disposed so that the longitudinal axis of same is essentially horizontal.

9. The tilt control assembly set forth in claim 2 including:

means for releasably locking the seat structure against the tilting movement.

10. The tilt control assembly set forth in claim 9 wherein:

said releasable locking means is operative to lock the seat structure against the tilting movement only in the upright most position of the seat structure relative to its support post.

11. The tilt control assembly set forth in claim 2 wherein:

the horizontal axis defined by said seat mount arms is located with respect to the chair seat structure front such that the chair seat structure front rises no more than about one inch when maximum rearward tilting movement of the chair structure is effected.

* * * * *